US009731346B2

(12) United States Patent
De Luca et al.

(10) Patent No.: US 9,731,346 B2
(45) Date of Patent: Aug. 15, 2017

(54) CONTROL DEVICE FOR OSCILLATING TABLE

(71) Applicant: Danieli & C. Officine Meccaniche S.P.A., Buttrio (IT)

(72) Inventors: Andrea De Luca, Remanzacco (IT); Stefano Del Tedesco, Fontanafredda (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 15/117,813

(22) PCT Filed: Feb. 13, 2015

(86) PCT No.: PCT/IB2015/051074
§ 371 (c)(1),
(2) Date: Aug. 10, 2016

(87) PCT Pub. No.: WO2015/121829
PCT Pub. Date: Aug. 20, 2015

(65) Prior Publication Data

US 2017/0008076 A1 Jan. 12, 2017

(30) Foreign Application Priority Data

Feb. 14, 2014 (IT) ..... M12014A0223

(51) Int. Cl.
*B22D 11/053* (2006.01)
*B22D 11/16* (2006.01)

(52) U.S. Cl.
CPC ..... *B22D 11/166* (2013.01); *B22D 11/053* (2013.01)

(58) Field of Classification Search
CPC ..... B22D 11/053; B22D 11/166
USPC ..... 164/416, 478
See application file for complete search history.

(56) References Cited

U.S. PATENT DOCUMENTS 5,350,005 A * 9/1994 Sorimachi ..... B22D 11/166 164/154.1
5,458,182 A * 10/1995 Aoki ..... B22D 11/166 128/925

FOREIGN PATENT DOCUMENTS

| | | | |
|---|---|---|---|
| CN | 202461462 | 10/2012 | |
| DE | 19845357 | 4/2000 | |
| DE | EP 0992302 A1 * | 4/2000 | ..... B22D 11/053 |
| DE | 19925564 | 12/2000 | |
| DE | 102010012975 | 9/2011 | |

(Continued)

OTHER PUBLICATIONS

EPO machine translation of CN 202461462 U, Oct. 3, 2012.*

*Primary Examiner* — Kevin E Yoon
(74) *Attorney, Agent, or Firm* — Stetina Brunda Garred & Brucker

(57) ABSTRACT

A control device (1) for an oscillating table (6), comprising: —a closed and pressurized hydraulic circuit (20), —a hydraulic actuator (21) connected to said hydraulic circuit (20) and adapted to be connected to the mobile part of the oscillating table (6) to adjust the position thereof, in which said hydraulic actuator (21) is a double-acting cylinder having a first chamber (21*a*) and a second chamber (21*b*) delimited from each other by a sliding piston (22) rigidly connected to a first rod (31*a*) which is rigidly restrainable to said mobile part, in which said hydraulic circuit (20) comprises at least one reversible hydraulic pump (9) directly connected to at least one of said first chamber (21*a*) and second chamber (21*b*).

17 Claims, 3 Drawing Sheets

(56) References Cited

FOREIGN PATENT DOCUMENTS

| | | | |
|---|---|---|---|
| EP | 1911659 | | 4/2008 |
| GB | 933874 | | 8/1963 |
| JP | 2003211256 A | * | 7/2003 |

* cited by examiner

CONTROL DEVICE FOR OSCILLATING TABLE

CROSS REFERENCE TO RELATED APPLICATIONS

The present application claims priority to PCT International Application No. PCT/IB2015/051074 filed on Feb. 13, 2015, which application claims priority to Italian Patent Application No MI2014A000223 filed Feb. 14, 2014, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to an oscillating table, in particular a table used in plants for producing billets, blooms or slabs to allow the oscillation of the crystallizer inserted in a ingot mould.

STATE OF THE ART

The oscillating table is a known element in the field of metallurgy, which places the ingot mould in oscillating movement and, therefore, the crystallizer in which the casting occurs. Due to this repetitive movement, the skin formed in the crystallizer does not stick to the walls thereof and, furthermore the lubricant is caused to circulate along the walls.

The oscillating table is characterized by the presence of one or more actuators which impose a typically periodic oscillation, generally sinusoidal, to the structure of the oscillating table. The oscillation required varies according to the casting speed, the casting material and the other operating parameters.

Two types of control devices for oscillating table are known in the state of the art: electromechanical and hydraulic.

Electromechanical control devices are based on a rod-crank principle which does not ensure a wide range of possible oscillations, since the amplitude of the oscillation is difficult to regulate. Therefore, it is not possible to entirely adapt to the production changes in the line with this kind of actuator; they are therefore optimal for single-product casting lines but not very suitable for multi-brand and multi-section lines.

Hydraulic or hydrodynamic control devices instead allow adaptation to all kinds of product, since they are capable of easily vary oscillation frequency and amplitude, but they require the presence of control units, hydraulic valves and flexible tubes which are even hundreds of meters long, with consequent significant increase in volumes and costs. Frequent maintenance is also required, in particular due to the effect of the presence of a high number of mobile components subject to wear and due to the effect of the required presence of an oil filtering system. Furthermore, conventional hydraulic devices are of the dissipative type: they indeed provide for the fluid to be in continuous circulation upstream of a servo-valve. which allows the passage thereof towards the hydraulic actuator only when required. A device of this type requires a significant quantity of fluid, supplied by an external source, and implies that there is a continuous consumption of energy to generate the circulation of the fluid along the flexible tubes joining the actuator to the control unit, which are typically several tens of meters long but may also reach several hundred meters.

Furthermore, the servo-valves generally comprised in conventional hydraulic devices determine a plurality of drawbacks, the main ones being:

- the operation thereof is in an open circuit at atmospheric pressure, with consequent need to include external hydraulic connections, for example such a circuit is described in publication CN202461462U;
- the need for a sophisticated filtering system in order to limit the possibilities of servo-valve malfunctioning;
- high operating and maintenance costs, since servo-valves normally have reduced lifecycles;
- low operating speed of the servo-valve, with consequent low overall reactivity of the hydraulic circuit.

SUMMARY OF THE INVENTION

It is the primary object of the present invention to make an oscillating table for production plants of billets, blooms or slabs, which allows the crystallizer to oscillate at the most suitable frequency and amplitude, thus obviating the drawbacks mentioned above, with reference to the known art.

In particular, the intention is to propose a hydraulic control device of the oscillating table which is of the conservative type, that is which consumes exclusively the quantity of energy strictly required to move the table.

A further object is to provide a hydraulic control device which allows reaching good levels of performance in terms of reactivity and accuracy, while at the same time ensuring minimum volumes.

Another object is to make a hydraulic control device which requires a reduced level of maintenance.

Thus, the present invention proposes to achieve the above-mentioned objects by providing a control device for oscillating table which, according to claim 1, is usable to adjust the oscillation of a mobile part of said oscillating table, and comprises a hydraulic circuit; a hydraulic actuator connected to said hydraulic circuit and adapted to be connected to the mobile part of the oscillating table to adjust the position thereof; in which said hydraulic actuator is a double-acting cylinder having a first chamber and a second chamber delimited from each other by a sliding piston rigidly connected to at least one rod which is rigidly restrainable to said mobile part; in which said hydraulic circuit is a closed circuit and pressurized at a pressure above the atmospheric pressure, and comprises at least one reversible hydraulic pump, which is activated by means of a motor and is directly connected to at least one of said first and second chamber with one or more ducts, without interposition of servo-valves, whereby the control of the hydraulic flow is performed directly by at least one hydraulic pump.

The feature of inserting a closed hydraulic circuit pressurized at a pressure typically exceeding 1 bar, advantageously between 2 and 6 bar, even more advantageously which can arrive up to a maximum limit equal to 25 bar, allows the hydraulic actuators to be controlled with the pump alone, unlike known systems which provide the presence of servo-valves to control the hydraulic circuit, all to the advantage of the energy balance of the oscillating table of the invention.

The present invention also relates to an oscillating table comprising a mobile part that can oscillate along a casting direction, and the aforesaid control device for said mobile part.

The dependent claims describe preferred embodiments of the invention.

BRIEF DESCRIPTION OF THE FIGURES

Further features and advantages of the invention will be more apparent in light of the detailed description of preferred, but not exclusive, embodiments of an oscillating table, disclosed by way of a non-limiting example with the aid of the accompanying drawings in which.

The same reference numerals in the different drawings identify the same elements or components.

DETAILED DESCRIPTION OF PREFERRED EMBODIMENTS OF THE INVENTION

With reference to the Figures, preferred embodiments are depicted of an oscillating table 6, the object of the present invention, provided with a hydraulic device 1 for controlling the vertical position of table 6, on which there is fastened an ingot mould 7, inside of which a crystallizer (not shown) is inserted.

Figure 1:
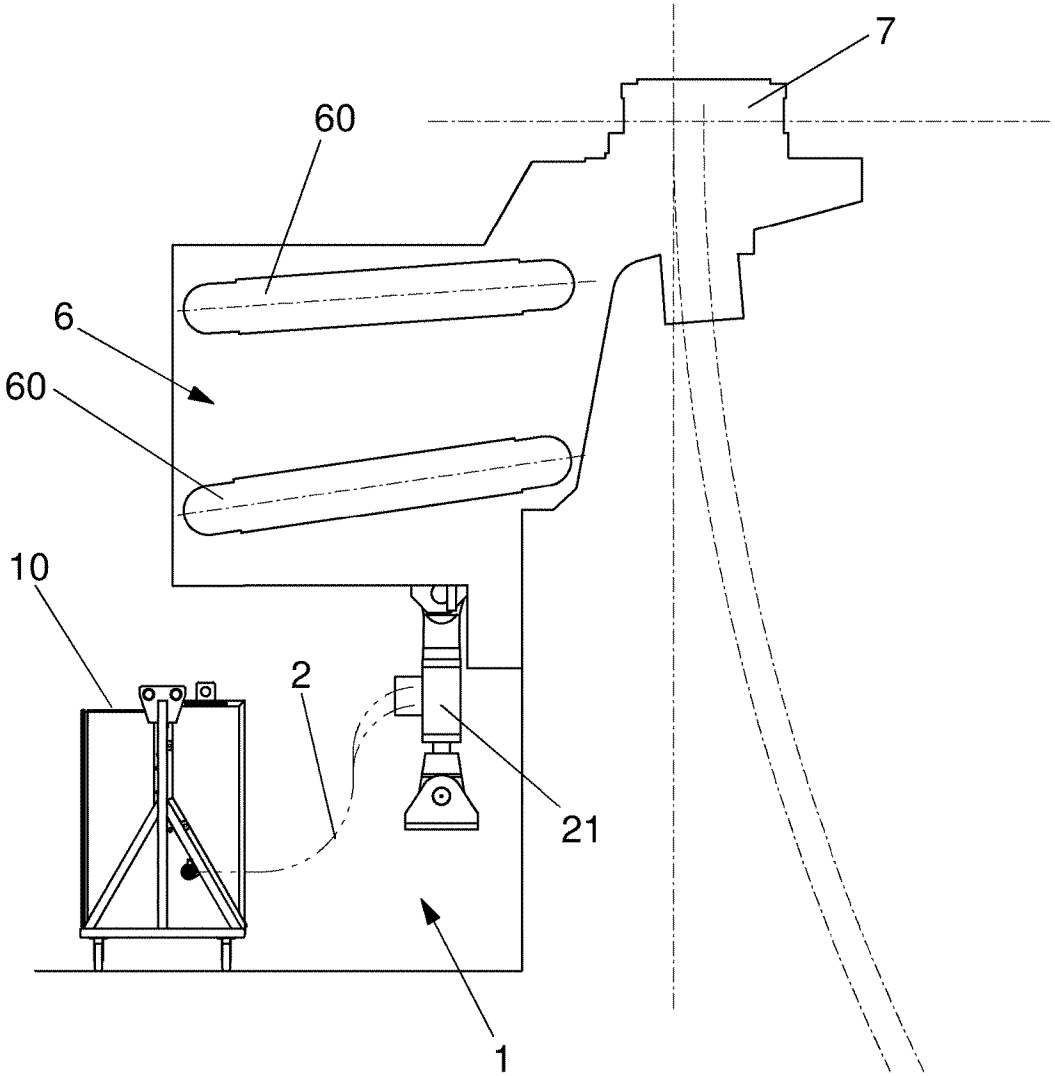
FIG. 1 depicts a side view of an oscillating table according to the invention.

With reference to FIG. 1, the hydraulic device 1 comprises a containment frame 10, inside of which there is provided a hydraulic circuit 20, advantageously of the closed and pressurized type (illustrated in its variants in FIG. 2 and in FIG. 3), connected by means of flexible tubes 2 or connected directly to a hydraulic actuator 21 arranged extremely close to the containment frame 10 and connected to the oscillating table 6 to adjust the height thereof. With respect to open type hydraulic circuits in which one of the two branches is ideally at atmospheric pressure, used in conventional dissipative hydraulic devices for oscillating table, which typically comprise a hydraulic control unit, the hydraulic circuit 20 is characterized by very small dimensions.

Figure 2:
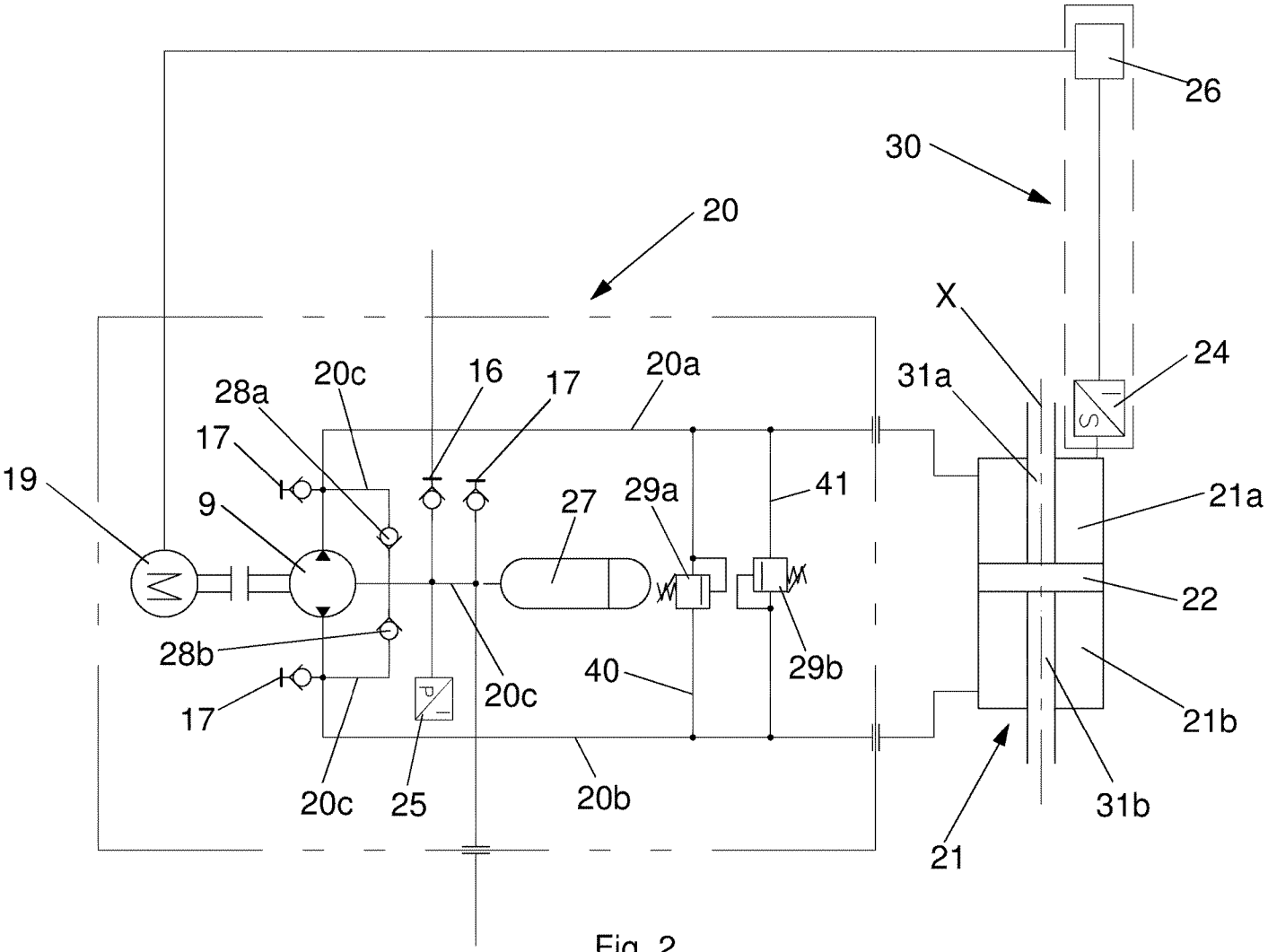
FIG. 2 depicts a first embodiment of a hydraulic scheme for activating a control device of the oscillating table in FIG. 1.

With reference to a first embodiment of the invention, shown in FIG. 2, the hydraulic actuator 21 is of the double-acting type, comprising a first chamber 21*a* and a second chamber 21*b* between which a piston 22 slides which delimits said two chambers 21*a*, 21*b* from each other. Piston 22 is rigidly connected to an upper first rod 31*a* and to a lower second rod 31*b*, opposite to rod 31*a* and of equal diameter with respect to the latter. The middle piston 22 slides in both the directions of a same axial direction coincident with a longitudinal axis X of the hydraulic actuator 21. The upper rod 31*a* is connected to the mobile structure of the oscillating table 6. Table 6 is restrained to guides 60 which allow the movement thereof only on a circumference so that the ingot mould 7, and therefore the crystallizer, oscillates along the circumference defined by the casting radius. The position of table 6, and therefore of the ingot mould 7, depends on the position of piston 22.

To control the movement of piston 22, the hydraulic circuit 20 comprises a reversible pump 9 directly connected to the first chamber 21*a* and to the second chamber 21*b* of actuator 21, by means of a first branch 20*a* and a second branch 20*b*, respectively, of the hydraulic circuit 20.

The rotation of the reversible volumetric pump 9 in one direction or in the other allows the oil to be directly sent to one or to the other of the chambers 21*a*, 21*b*, respectively, of actuator 21, thus determining the movement of the piston 22 and of the rod 31*a*, 31*b* in one direction or in the opposite one. According to another variant of the invention, other equivalent fluid is usable inside circuit 20 in place of the oil.

In one variant of the first embodiment, only the upper rod 31*a* is provided, whereby the thrust force is a "full" thrust force because the fluid (oil) acts on the entire lower flat surface of piston 22. Instead in the variant in FIG. 2, the thrust force is an "annular" thrust force because the fluid (oil) acts on the lower flat surface of piston 22, excluding the portion occupied by the lower rod 31*b*.

Two connecting branches 40, 41 are provided between the first branch 20*a* and the second branch 20*b* of the hydraulic circuit 20, each equipped with a maximum pressure valve 29*a*. 29*b*, which is calibrated so as to protect the hydraulic circuit from pressure overloads resulting from excessive loads. The first branch 20*a* and the second branch 20*b* are connected, upstream of the reversible pump 9, by means of a third branch 20*c*, to an accumulator or replenishing source 27, which allows any fluid leaks from the hydraulic circuit 20 to be replenished and the variations in fluid volume to be managed.

A first and a second non-return valve 28*a*, 28*b*, oriented so as to prevent the flow from the branches 20*a* and 20*b* towards the replenishing source 27, are provided on two branchings of the third branch 20*c* between the replenishing source 27 and the reversible pump 9, respectively, thus allowing the flow in the opposite direction.

The replenishing source is also directly connected to the reversible pump 9 by means of said third branch 20*c* of the hydraulic circuit 20.

Pump 9 is activated by means of an electric motor 19, advantageously of the brushless type or of the stepper type.

The use of the reversible pump 9 and of the brushless motor 19 allows the first chamber 21*a* and the second chamber 21*b* of actuator 21 to be directly connected to pump 9, thus preventing the use of servo-valves, which are normally used in the conventional hydraulic circuits in which one of the two branches of the hydraulic circuit is at atmospheric pressure. This also allows the quantity of fluid required by the hydraulic circuit 20 and the overall length thereof to be decreased. For an application example characterized by 3.5 meter long flexible tubes 2, connecting, the hydraulic actuator 21 to the hydraulic circuit 20 inside of the containment frame 10, the quantity of fluid required to operate the hydraulic circuit 20, given by the sum of the fluid in circulation and of the fluid in the replenishing source 27, can advantageously range between 2 and 5 liters, preferably between 2 and 3 liters. The overall length of the hydraulic line in which the fluid circulates, without the flexible connection tubes 2 between the hydraulic actuator and the containment frame 10, is advantageously less than 3 meters, preferably less than 2 meters.

Furthermore, in the circuit there are provided pressure intakes 17, which allow the circuit to be bled when it is filled and brought under pressure for the first time through connection 16. The insertion of a pressure sensor 25 for performing a monitoring during operation can also be provided.

The position of piston 22 inside the cylinder is a function of the angular position of motor 19 of pump 9, while the movement speed of the piston is a function of the angular speed of pump 9. The reversible volumetric pump 9 allows the movement of the quantity of liquid actually required to move piston 22 required by the control system (it can also cause significantly small volumes of oil to flow). As the hydraulic circuit 20 is closed and pressurized with respect to the atmospheric pressure, that is without a hydraulic control unit, the same quantity of fluid always flows therein. Motor 19 of pump 9 determines all movements of fluid inside the hydraulic circuit 20: consequently, if motor 19 does not activate pump 9, the flow of fluid in all points of the hydraulic circuit 20 is substantially null and piston 22 is not subjected to movements. The device thus made is therefore of the conservative type since the consumption of energy is directly correlated to the movement of piston 22. Device 1 indeed consumes only the energy required to move table 6 and, in the moments in which a movement of table 6 is not required, the consumption of energy is null since the fluid is stopped in the whole circuit. In particular, when the oscillating table 6 is stopped because the casting process is not in progress, the consumption of energy is null; instead, in the state of the art, even when the oscillating table is kept stopped, the control unit must continuously recirculate the oil to keep it at temperature and thus prevent the risk of the servo-valves jamming.

The reversible pump 9, and therefore actuator 21, are controlled in a controlled manner. To allow the control of the reversible pump 9 and of actuator 21, the hydraulic device 1 comprises a control circuit 30 connected to the hydraulic circuit 20.

Figure 3:
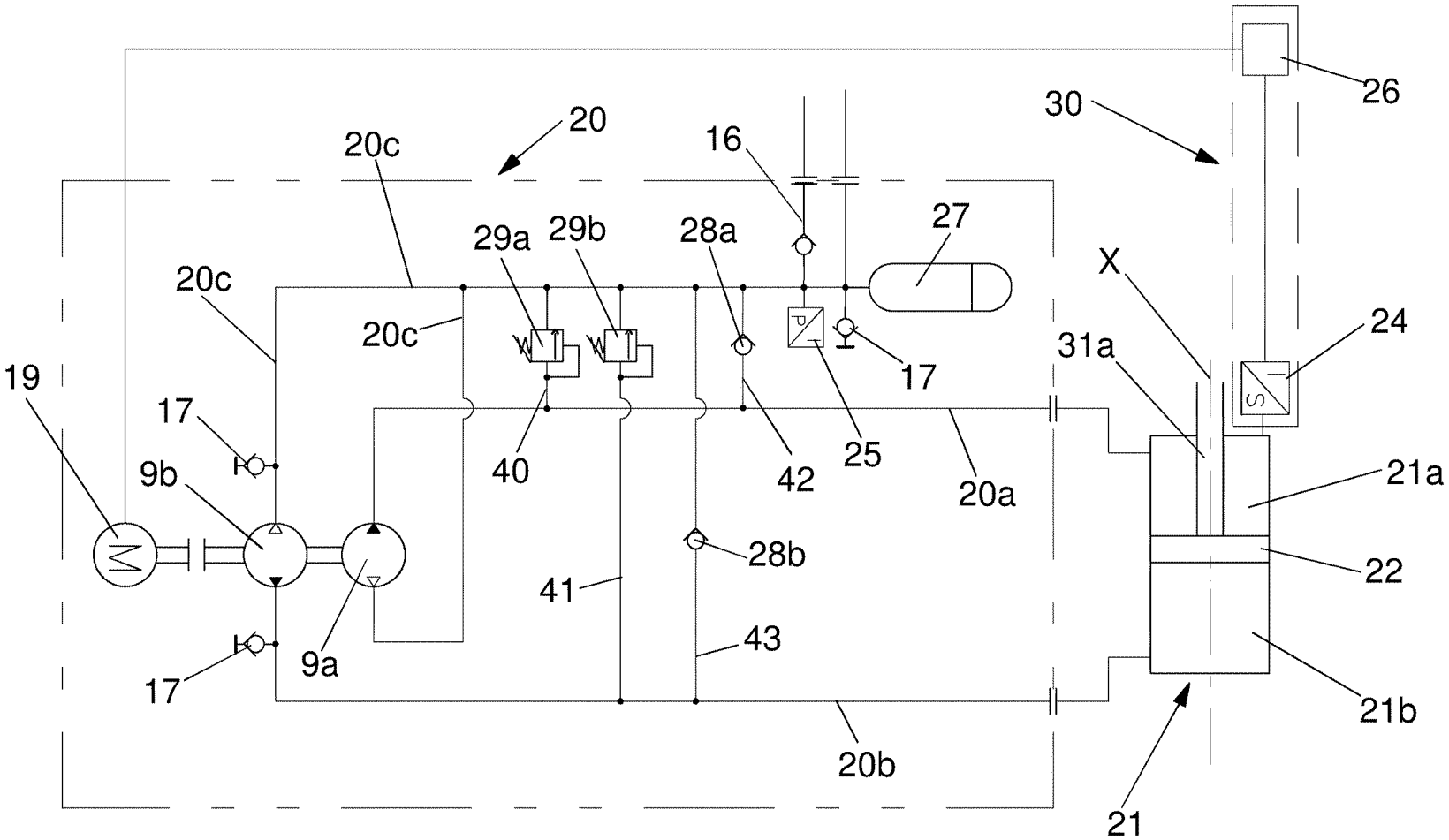
FIG. 3 depicts a second embodiment of a hydraulic scheme for activating a control device of the oscillating table in FIG. 1.

With reference to a second embodiment of the invention, shown in FIG. 3, the hydraulic actuator 21 is of the double-acting type, comprising a first chamber 21*a* and a second chamber 21*b* between which a piston 22 slides which delimits said two chambers 21*a*, 21*b* from each other. Piston 22 is rigidly connected to a single rod 31*a*, arranged through the upper first chamber 21*a*. The middle piston 22 slides in both the directions of a same axial direction coincident with, a longitudinal axis X of the hydraulic actuator 21. Rod 31*a* is connected to the mobile structure of the oscillating table 6. Table 6 is restrained to guides 60 which allow the movement thereof only on a circumference so that ingot mould 7, and therefore the crystallizer, oscillates along the circumference defined by the casting radius. The position of table 6, and therefore of ingot mould 7, depends on the position of piston 22.

To control the movement of piston 22, the hydraulic circuit 20, in place of the reversible pump 9 of the first embodiment, which is adapted to pump the oil in both directions, comprises two reversible pumps 9*a*, 9*b* which can actually rotate in both directions but allow the pumping only in one of the two directions, while they behave as ducts in the other of the two directions, thus simply letting the pressure to be bled through the passage of the oil. The pressure in these reversible pumps of the internal gear pair type is only and always generated by the so-called pressure side (having a first cross section), regardless of the direction of rotation; while pressure is not allowed on the so-called suction side (having a second cross section larger than said first section). Inversely, for example a controlled loss of pressure is possible against a standard direction of rotation, thus allowing the oil to flow through the pump from the pressure side to the suction side. This operation ensures the system is preloaded on the pressure side.

Pump 9*a* is directly connected to the first chamber 21*a* of actuator 21, by means of a first branch 20*a* of the hydraulic circuit 20. Pump 9*b* is instead directly connected to the second chamber 21*b* of actuator 21, by means of a second branch 20*b* of the hydraulic circuit 20, without the use of servo-valves in the ducts 20*a*, 20*b*.

The activation of pump 9*a* allows the oil, or other equivalent fluid, to be sent directly to the first chamber 21*a*, thus determining the movement of piston 22 and of rod 31*a* downwards along axis X.

The activation of pump 9*b* allows the oil, or other equivalent fluid, to be sent directly to the second chamber 21*b*, thus determining the movement of piston 22 and of rod 31*a* upwards along axis X.

Thus, the pumps 9*a* and 9*b* are activated alternately from each other so as to produce the oscillation of the oscillating table 6 at a predetermined frequency and amplitude. The pumps 9*a* and 9*b* are both activated by means of the electric motor 19, advantageously of the brushless type or of the stepper type.

In a variant of the second embodiment, the lower rod 31*b* can also be provided, whereby the thrust force from the bottom up is an "annular" thrust force because the fluid (oil) acts on the lower flat surface of piston 22, excluding the portion occupied by the lower rod 31*b*. Instead in the variant in FIG. 3, the thrust force from the bottom up is a "full" thrust force because the fluid (oil) acts on the entire lower flat surface of piston 22.

Pump 9*a* and pump 9*b* are connected, by means of a third branch 20*c* of circuit 20, to an accumulator or replenishing source 27, which allows any fluid leaks from the hydraulic circuit 20 to be replenished and the variations in fluid volume to be managed.

There is provided, between the first branch 20*a* and the third branch 20*c*, a connecting branch 40 equipped with a maximum pressure valve 29*a*, which is calibrated so as to protect the hydraulic circuit from pressure overloads resulting from excessive loads. Similarly, there is provided a connecting branch 41 equipped with a second maximum pressure valve 29*b* between the second branch 20*b* and the third branch 20*c*.

A first non-return valve 28*a*, oriented so as to prevent the flow from the first branch 20*a* towards the replenishing source 27, is provided between the replenishing source 27 and the reversible pump 9*a*, on a connecting branch 42 between the third branch 20*c* and the first branch 20, thus allowing the flow in the opposite direction. Similarly, there is provided a second non-return valve 28*b* between the replenishing source 27 and the reversible pump 9*b*, on a connecting branch 43 between the third branch 20*c* and the second branch 20*b*.

The use of the pumps 9*a* and 9*b* and of the brushless motor 19 allows the first chamber 21*a* to be connected directly to pump 9*a* and the second chamber 21*b* to be connected directly to pump 9*b*, thus preventing the use of servo-valves in ducts 20*a*, 20*b*, which connect the pumps 9*a*, 9*b* directly to the chambers 21*a*, 21*b* normally used in conventional hydraulic circuits. This also allows the quantity of fluid required by the hydraulic circuit 20 and the overall length thereof to be decreased.

Furthermore, in the circuit there are provided pressure intakes 17, which allow the circuit to be bled when it is filled and brought under pressure for the first time through connection 16. The insertion of a pressure sensor 25 for performing a monitoring during operation can also be provided.

The position of piston 22 inside the cylinder is a function of the angular position of motor 19, while the movement speed of the piston is a function of the angular speed of the pumps 9*a*, 9*b*. The reversible volumetric pumps 9*a*. 9*b* allow the movement of the quantity of liquid actually required for moving piston 22 required by the control system (it can also cause significantly small volumes of oil to flow). As the hydraulic circuit 20 is closed and pressurized, that is without a hydraulic control unit, the same quantity of fluid always flows therein. Motor 19 of the pumps 9*a*, 9*b* determines all movements of fluid inside the hydraulic circuit 20: consequently, if motor 19 does not activate the pumps 9*a*, 9*b*, the flow of fluid in all points of the hydraulic circuit 20 is substantially null and piston 22 is not subjected to movements. The device thus made is therefore of the conservative type since the consumption of energy is directly correlated to the movement of piston 22. Device 1 indeed consumes only the energy required to move table 6 and, in the moments in which a movement of table 6 is not required, the consumption of energy is null since the fluid is stopped in the whole circuit. In particular, when the oscillating table 6 is stopped because the casting process is not in progress, the consumption of energy is null; instead, in the state of the art, even when the oscillating table is kept stopped, the control unit must continuously recirculate the oil to keep it at temperature and thus prevent the risk of the servo-valves jamming.

The reversible pumps 9*a*, 9*b*, and therefore actuator 21, are controlled in a controlled manner. To allow the control of the reversible pumps 9*a*, 9*b* and of actuator 21, the hydraulic device 1 comprises a control circuit 30 connected to the hydraulic circuit 20.

In both the embodiments described above, the control circuit 30 can for example be based on predictive methods or act in feedback on the basis of the measure of certain operating parameters. In the case in which the control system 30 is in feedback, it can advantageously comprise a position transducer 24 for detecting the position of piston 22. The control circuit 30 also comprises a control unit 26, by means of which the electric motor 19 is controlled. The control unit 26 is connected to the position transducer 24, so as to obtain a feedback control, by comparing the oscillations wanted in the ingot mould according to casting parameters and those actually obtained with the movement of piston 22. The control is performed continuously.

In the embodiments described above, the closed and pressurized hydraulic circuit 20 is advantageously entirely accommodated in the containment frame 10, a part from the hydraulic actuator 21, which is arranged in an outer area of the containment frame 10, but closely connected thereto. The actuator is indeed to be secured to table 6 to be able to transmit the movement. In any event, the hydraulic circuit 20, being closed and pressurized, does not require external hydraulic connections and therefore a tank for the oil outside frame 10. The hydraulic circuit 20 can be advantageously sealed inside frame 10 so as to be isolated from the outside ambient which, within the scope of use of the present invention, is generally rather arduous due to the presence of dirt, dust or the like. This allows excessive wear of the components to be avoided and extended good operation of the plant to be ensured, thus minimizing maintenance interventions.

An alternative solution provides the possibility of installing the hydraulic actuator 21 complete with its activation unit, that is with the hydraulic circuit 20, on board of table 6.

The device of the present invention, comprising a closed and pressurized hydraulic plant in which only a minimum quantity of fluid is moved, that is only the quantity required to move the piston of the hydraulic actuator, does not determine waste of energy and for this is defined as conservative. The use of a device of this kind also allows a hydraulic device to be obtained, characterized by high performance and reactivity; this is further promoted by the fact that it uses hydraulic pumps controlled by an electric motor which allows high operating speeds to be reached.

The invention claimed is:

1. A control device for an oscillating table, said device being usable to adjust the oscillation of a mobile part of said oscillating table, said device comprising:

a hydraulic circuit a hydraulic actuator connected to said hydraulic circuit and adapted to be connected to the mobile part of the oscillating table to adjust the position thereof, wherein said hydraulic actuator is a double-acting cylinder having a first chamber and a second chamber delimited from each other by a sliding piston rigidly connected to at least one rod which is rigidly restrainable to said mobile part, wherein said hydraulic circuit is a closed circuit and is pressurized at a pressure above the atmospheric pressure, and comprises at least one reversible hydraulic pump, which is activated by means of a motor and is directly connected to at least one of said first chamber and second chamber with one or more ducts, without interposition of servo-valves, whereby the control of the hydraulic flow is performed directly by at least one hydraulic pump.

2. The control device according to claim 1, wherein there is provided a control circuit connected to said hydraulic circuit to control the position of said piston.

3. The control device according to claim 2, wherein said control circuit is adapted to act in feedback.

4. The control device according to claim 3, wherein said control circuit comprises a position transducer for detecting the position of the piston.

5. The control device according to claim 4, wherein said control circuit comprises a control unit connected to said motor and to said position transducer.

6. The control device according to claim 1, wherein said hydraulic circuit is completely accommodated within a containment frame.

7. The control device according to claim 1, wherein said hydraulic circuit comprises only one reversible hydraulic pump, which is directly connected to said first chamber and second chamber, by means of a first branch and a second branch, respectively, of said hydraulic circuit.

8. The control device according to claim 7, wherein there are provided two connecting branches, each equipped with a maximum pressure valve, between the first branch and the second branch of the hydraulic circuit.

9. The control device according to claim 7, wherein the reversible hydraulic pump, the first branch and the second branch are connected, by means of a third branch, to a replenishing source which allows any eventual fluid leaks from the hydraulic circuit to be replenished.

10. The control device according to claim 9, wherein a first non-return valve and a second non-return valve, oriented so as to prevent the flow towards the replenishing source, are provided, respectively, on two branchings of the third branch which are connected to the first branch and to the second branch, respectively.

11. The control device according to claim 1, wherein said hydraulic circuit comprises two reversible hydraulic pumps, adapted to rotate in both directions but to pump in only one of the two directions; a first hydraulic pump of said two hydraulic pumps being directly connected to the first chamber by means of a first branch of the hydraulic circuit, and a second hydraulic pump being directly connected to the second chamber by means of a second branch of the hydraulic circuit.

12. The control device according to claim 11, wherein the motor is adapted to alternatively activate the first hydraulic pump and the second hydraulic pump so as to produce the oscillation of the oscillating table at a predetermined frequency and amplitude.

13. The control device according to claim 11, wherein the first hydraulic pump and the second hydraulic pump are connected, by means of a third branch of the hydraulic circuit, to a replenishing source which allows any eventual fluid leaks from the hydraulic circuit to be replenished.

14. The control device according to claim 13, wherein there is provided a first connecting branch equipped with a first maximum pressure valve between the first branch and the third branch, and wherein there is provided a second connecting branch equipped with a second maximum pressure valve between the second branch and the third branch.

15. The control device according to claim 13, wherein a first non-return valve, oriented so as to prevent the flow from the first branch to the replenishing source, is provided between the replenishing source and the first reversible pump on a connecting branch between third branch and first branch, and wherein a second non-return valve, oriented so as to prevent the flow from the second branch to the replenishing source, is provided between the replenishing source and the second reversible pump, on a further connecting branch between third branch and second branch.

16. The control device according to claim 1, wherein there is provided a further rod connected to the piston and arranged in the second chamber.

17. An oscillating table comprising a mobile part that can oscillate along a casting direction, and a control device, according to claim 1, for said mobile part.

* * * * *